US006669242B2

(12) United States Patent
Fountaine et al.

(10) Patent No.: US 6,669,242 B2
(45) Date of Patent: Dec. 30, 2003

(54) LATCH DEVICE

(75) Inventors: Howard John Fountaine, Wellington (NZ); Rana James Waitai, Wellington (NZ)

(73) Assignee: Assa Abloy Financial Services AB, Stockholm (SE)

( * ) Notice: Subject to any disclaimer, the term of this patent is extended or adjusted under 35 U.S.C. 154(b) by 0 days.

(21) Appl. No.: 10/177,850

(22) Filed: Jun. 19, 2002

(65) Prior Publication Data

US 2002/0195824 A1 Dec. 26, 2002

(30) Foreign Application Priority Data

Jun. 20, 2001 (NZ) ..... 512510

(51) Int. Cl.[7] ..... E05C 7/00

(52) U.S. Cl. ..... 292/11; 292/DIG. 47; 292/27

(58) Field of Search ..... 292/11, 25, 27, 292/45, 47, 46, 49, DIG. 20, DIG. 47

(56) References Cited

U.S. PATENT DOCUMENTS

| | | | | | |
|---|---|---|---|---|---|
| 857,922 | A | * | 6/1907 | Campbell | |
| 2,540,686 | A | * | 2/1951 | Milburn | 292/124 |
| 2,668,070 | A | * | 2/1954 | Schmitt | 292/27 |
| 4,554,907 | A | * | 11/1985 | Overley | 126/191 |
| 5,171,048 | A | * | 12/1992 | Weinerman | 292/45 |
| 5,915,766 | A | * | 6/1999 | Baumeister | 292/341.15 |

* cited by examiner

*Primary Examiner*—Gary Estremsky
(74) *Attorney, Agent, or Firm*—Blakely, Sokoloff, Taylor & Zafman

(57) ABSTRACT

A latch device for sliding and hung window systems. The latch device has a mounting base (15) with which a pair of counter-rotatable cam elements (11) are mounted. A lever cover (12) is slidingly mounted on the base (15). The lever cover (12) is coupled to the cam element (11) so that sliding movement of the lever cover (12) causes the cam elements to counter-rotate. Each cam element (11) has a cam portion (22) which is engageable through an opening (41) in a keeper (14) to latchingly engage behind a cam engagement surface (42) associated with the opening (41).

18 Claims, 8 Drawing Sheets

LATCH DEVICE

BACKGROUND OF THE INVENTION

This invention relates to a latch device.

With sliding and hung window systems it is necessary to include a latch device (sometimes referred to as a "sash lock") to latch the window in a closed position. Over the years there have been many proposed types of window latches which aim to provide not only secure latching but also ease of operation. Despite the wide range of proposals which have been developed over the years there still exists the possibility of an improved latch device for sliding and hung window systems.

For example, with known latches for sliding and hung window systems forces can arise when the latching operation is carried out which causes the window to move off centre. This can result in sealing problems, distortion of window sash/rails, undesirable loadings applied to mounting hardware etc. These undesirable forces generated in the window generally arise from the use of a cam and keeper arrangement which is a typical latching mechanism for sliding and hung window systems.

Also there exists the need to ensure that that latching device prevents or renders difficult unauthorised access to be gained by external manipulation of the latch in order to release the latch tongue. To achieve this objective it is known to include a shroud or shield arrangement which prevents someone outside the window from engaging between, e.g. the window sashes, a thin tool to apply force to the latching tongue or cam to release it from the keeper. Such arrangements have not always been successful.

There also exists the possibility of improving the operative mechanism of such latches to not only improve the application of physical effort to operate the latch device but to additionally try and improve the aesthetic appeal of the latch. There is a move these days to have window hardware which, when visible, has a more pleasing appearance than has hitherto been thought to be necessary.

SUMMARY OF THE INVENTION

It is thus an object of the present invention to provide a latch device for sliding and hung window systems the latch device being of a construction which goes some way to achieving one or more of the above identified desired features.

Broadly, according to one aspect of the invention there is provided a latch device for sliding and hung window systems the latch device including a mounting base, a pair of counter-rotable cam elements coupled to the base, a lever cover slidingly engaged with the mounting base and a coupling mechanism which couples the lever cover to the cam elements whereupon in use a sliding movement of the lever cover is translated into pivotal movement of the cam elements.

The latch device further includes a keeper having a pair of cam engagement surfaces with which the cam elements are engagable to latch the mounting base to the keeper. Preferably the keeper includes a body having a pair of openings within each of which is located a said cam engagement surface.

Preferably the latch further includes a deadlocking means for whereby in use the cam elements can be deadlocked when in the latching position.

According to one preferred embodiment to the invention each cam element includes a follower which engages within a groove associated with the lever cover.

In a preferred form of the invention the latch device further includes detent means whereby the lever cover is releasably held in positions corresponding to the latch device being in the latching and unlatching positions.

BRIEF DESCRIPTION OF THE DRAWINGS

In the following more detailed description of the invention according to one preferred embodiment reference will be made to the accompanying drawings in which.

DESCRIPTION OF THE PREFERRED EMBODIMENT

Figure 1:
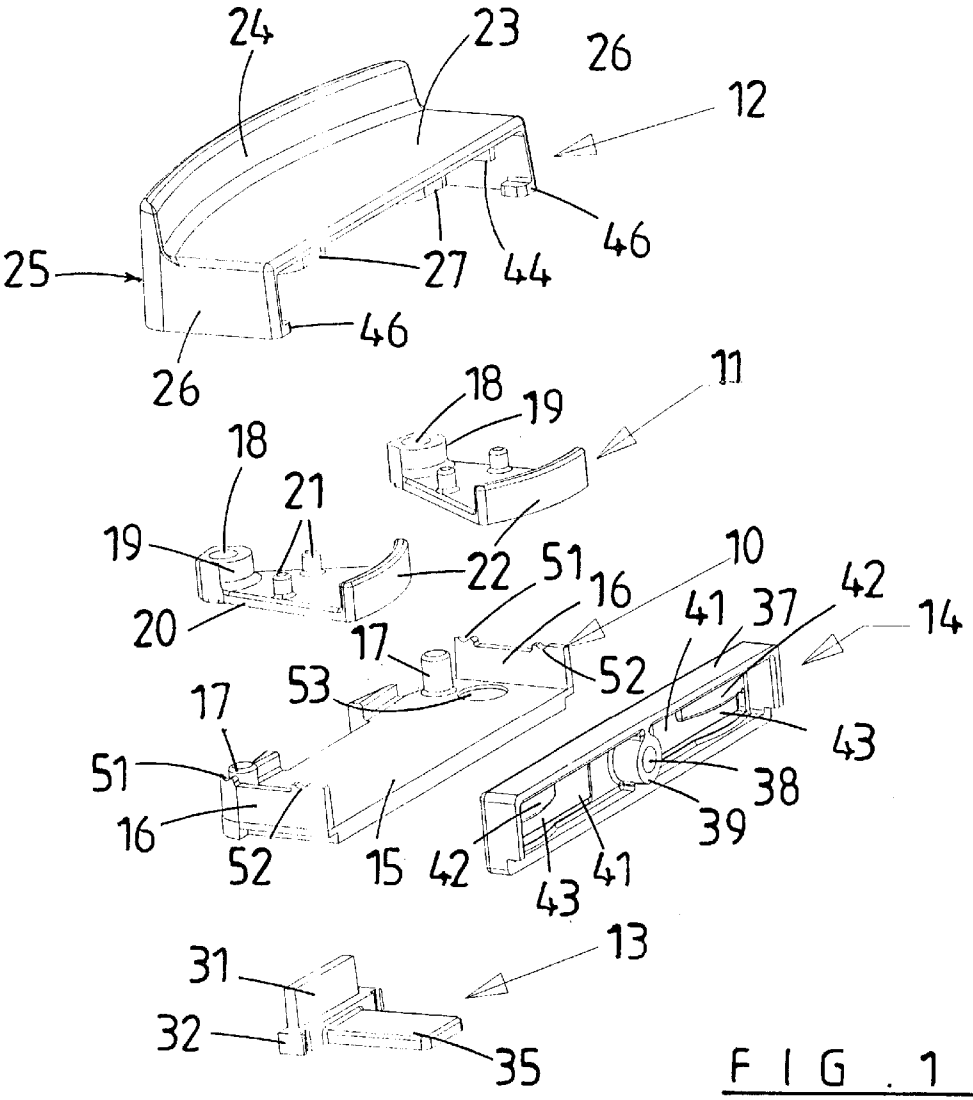
FIG. 1 is an exploded view of the components of the latch device.
Figure 2:
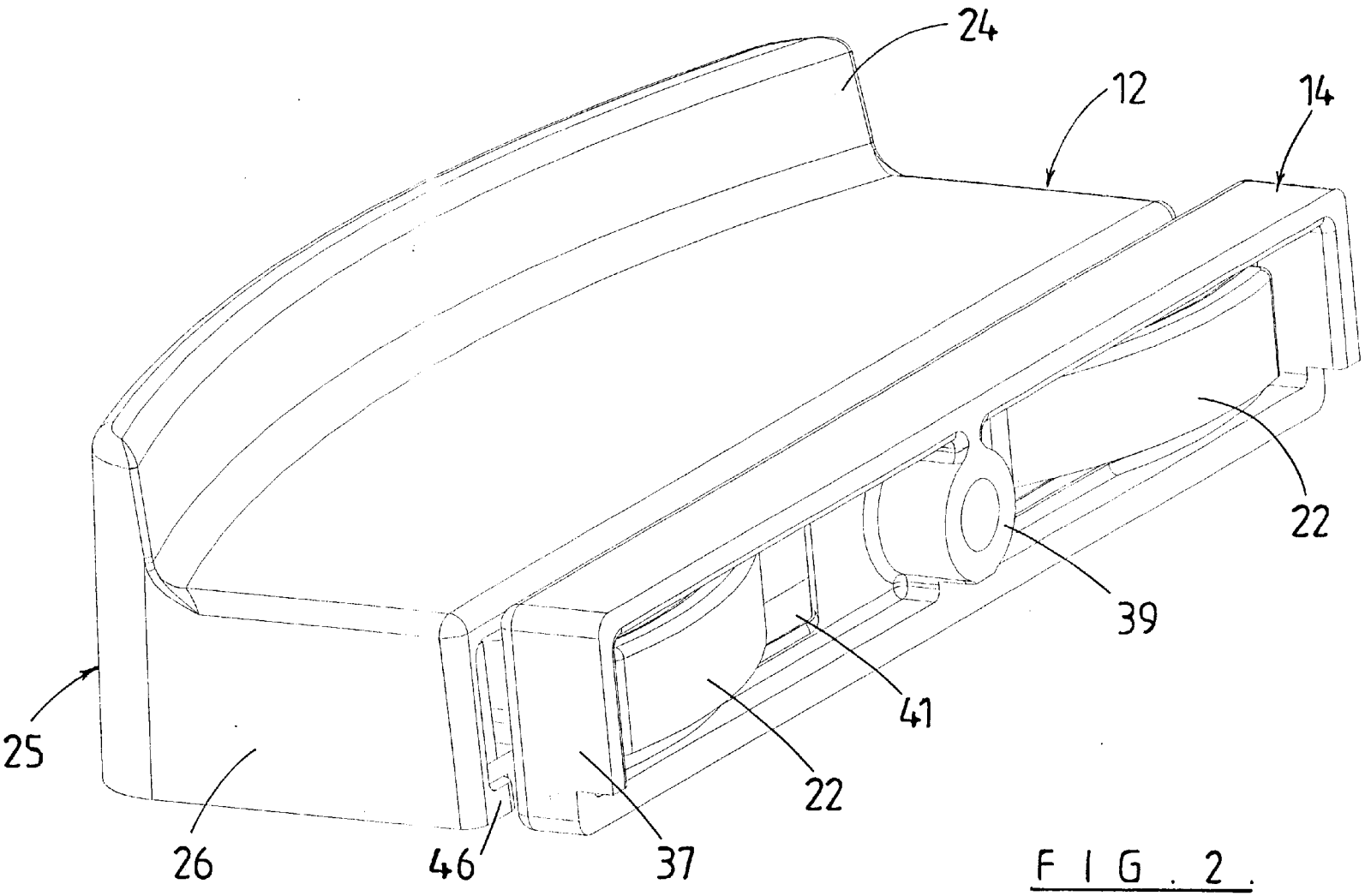
FIG. 2 is a perspective view of the latch device in the latched position.

Referring firstly to FIG. 1 of the drawings the various components of the latch device are shown in exploded view. The components comprise a base 10, a pair of cam arms 11, a lever cover 12, a support finger 13, and a keeper 14. Conveniently the cam arms 11 are identical.

The base 10 (which can be formed for engineering plastic) includes a floor 15 with a pair of opposing end walls 16.

Adjacent each end wall is a spigot 17 each of which engages within bore 18 of boss 19 of a cam arm 11. The cam arm 11 is thus able to pivot about a pivot axis defined by the spigot 17.

Each cam arm 11 includes an arm 20 which radiates from boss 19. Upwardly projecting from arm 20 is a pair of pins 21. The distal end of the arm 20 includes an upstanding cam portion 22.

The lever cover 12 (which can be of die cast Zinc construction) includes a cover portion 23 from one side of which projects an upstand 24. A wall 25 extends downwardly from the upstand 24 and merges into a pair of opposed end walls 26. The upstand 24 forms a gripping portion to be gripped in or engaged by the fingers of a user.

Figure 6:
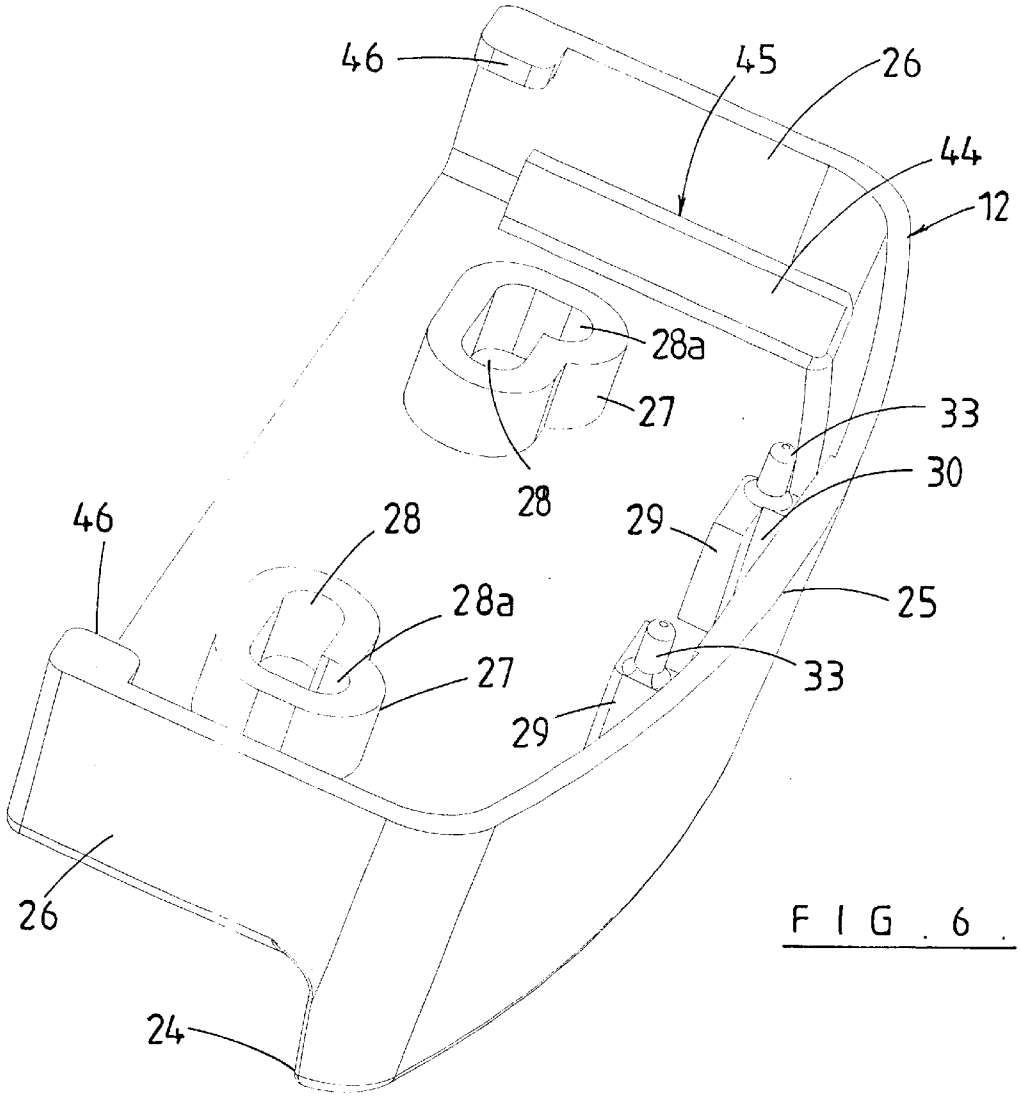
FIG. 6 is an underneath perspective view of the lever cover.
Figure 7:
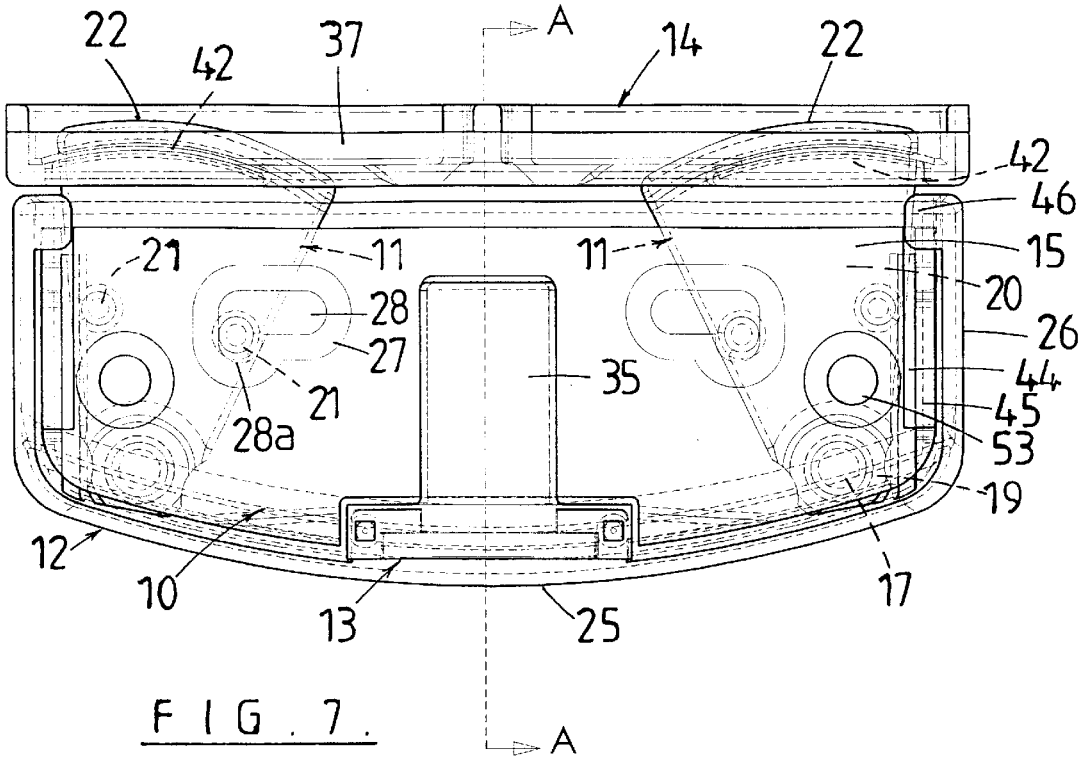
FIG. 7 is a detailed drawing of the latch in the latched position showing hidden detail.
Figure 8:
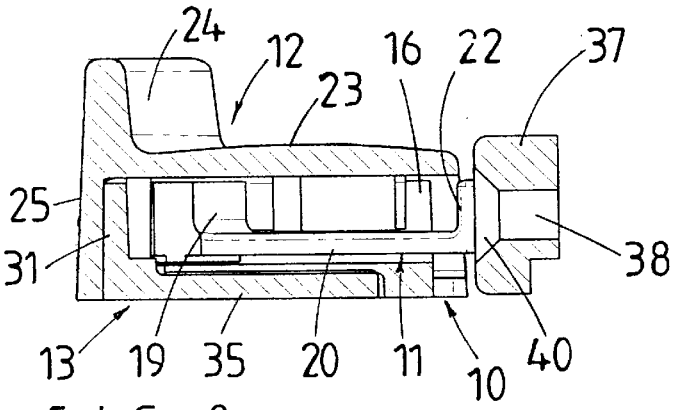
FIG. 8 is a section view on line A A of FIG. 7.
Figure 9:
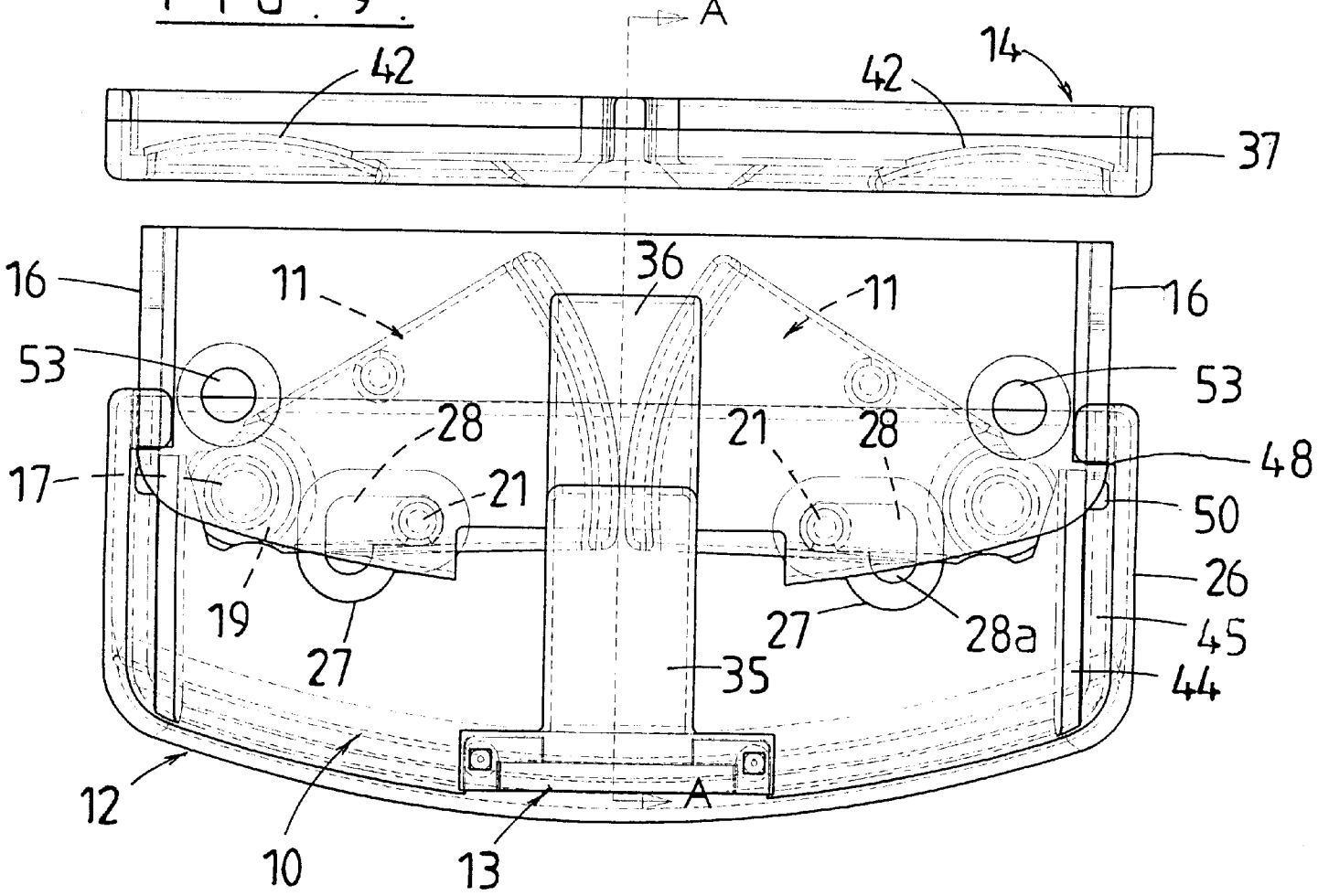
FIG. 9 is a view similar to FIG. 7 but showing the latch device in the unlatched position.

Projecting downwardly from the underside of cover portion 23 is a pair of shaped continuous walls 27 each of which define an actuation slot 28 (see more particularly FIGS. 6, 7 and 9). Into each of these actuation slots 28 engages a pin 21 of a cam arm 11 as can be seen for example in FIGS. 7 and 9.

Referring to FIG. 6 there is shown a pair of spaced apart opposing L shaped walls 29 which extend from the inner surface of the wall 25 and define therebetween a slot 30. Into this slot engages a tongue 31 which projects from a base portion 32 of support finger 13. A pair of pins 33 which project from an edge of each of walls 29 engage in openings 34 in the base 32.

Figure 3:
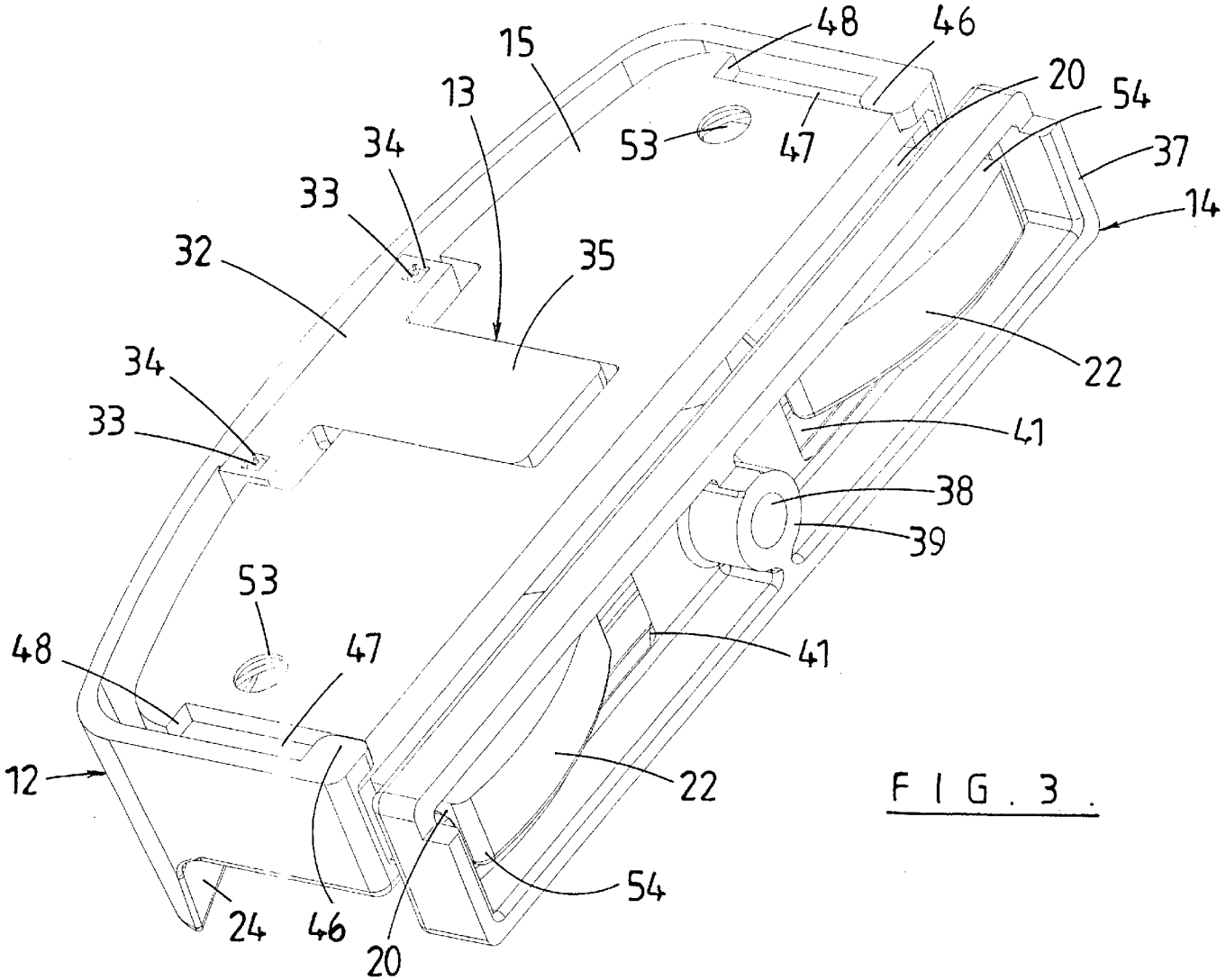
FIG. 3 is an underside view of FIG. 1.
Figure 4:
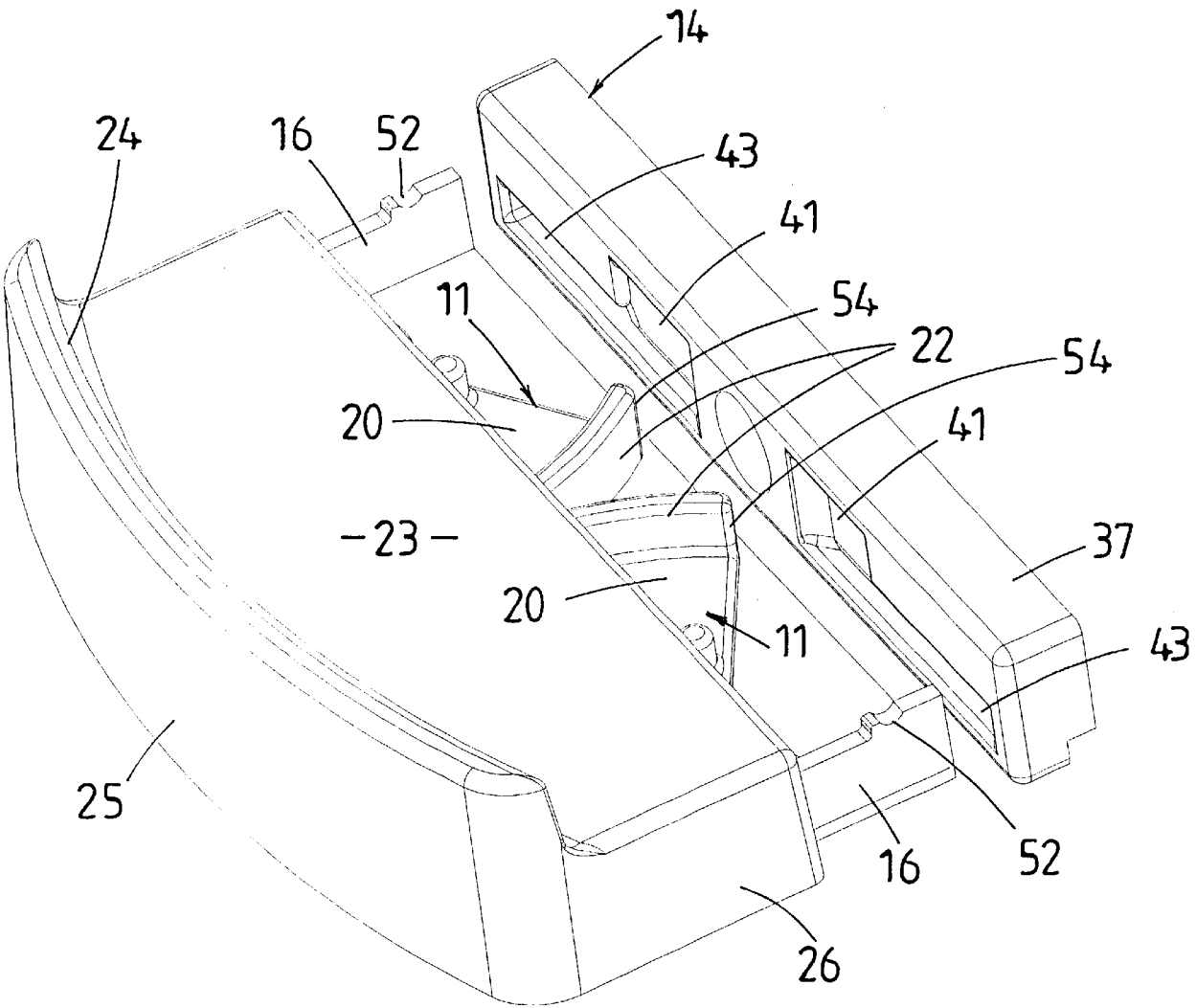
FIG. 4 is a perspective view from essentially the opposite direction of that of FIGS. 1 and 2 but showing the latch device in an unlatched position.
Figure 5:
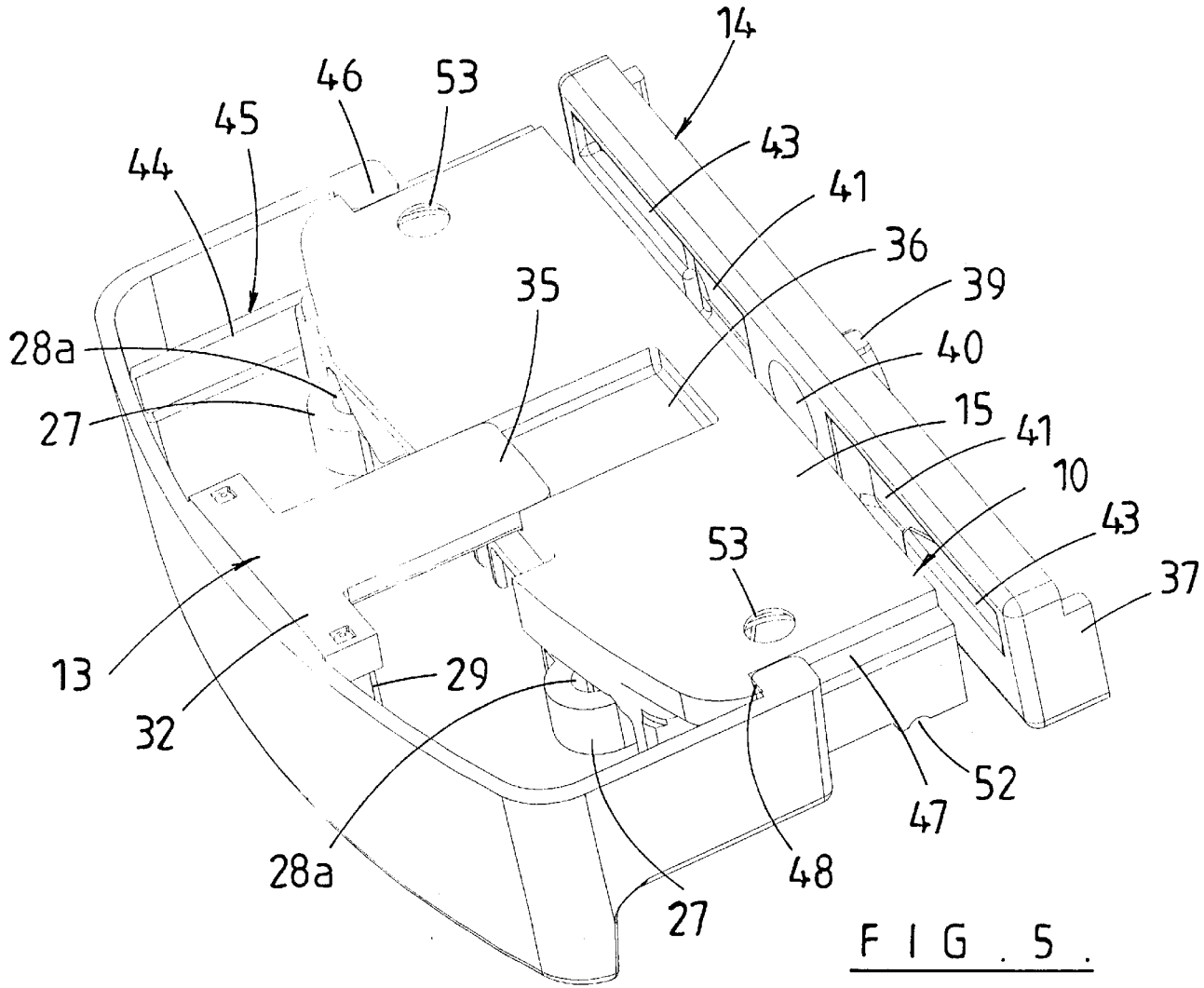
FIG. 5 is a view similar to FIG. 3 but showing the underside of the latch device.

As can be seen, for example, in FIGS. 3 and 5 the support finger 13 when installed in the lever cover 12 is arranged so that the finger 35 projects laterally relative to wall 25 of the lever cover 12. These Figures also show how the finger 35 engages in an elongate recess 36 in the underside of floor 15 of base 10. The elongate recess 36 is one at one end to receive the finger 35.

The keeper 14 is formed of a body 37 which has a centrally located mounting bore 38. This bore 38 is formed in a spigot 39 and is accessible through a counterbore 40 in the front surface of the body 37.

Flanking the counterbore 40 is a pair of elongate openings 41. As can be more clearly seen in FIGS. 1 and 9 a cam engagement surface 42 is associated with each opening 41. The cam engagement surface 42 is of curved configuration such that it is inter-engagable with the curved cam portion 22 of the cam arm 11. A clearance 43 is provided between cam engagement surface 42 and one long side of opening 41.

Referring to FIG. 6 of the drawings it will be observed that running parallel to the inside surface of end walls 26 and extending from wall 25 is a partition wall 44. The spaced apart walls 26 and 44 thus form a track 45 into which the sidewall 16 of base 10 slidingly engages.

A tab 46 at the distal corner of wall 26 engages (see FIGS. 3 and 5) in a recess 47 in the underside of floor 15 of base 10. A shoulder 48 at the end of recess 47 inter-engages with the tab 46 to form a stop which defines the end point of the movement of the lever cover 12 relative to base 10 when the latch device is in the open or unlatched position (see for example FIGS. 5 and 9).

As can be seen in e.g. FIG. 9 a small projection 50 is formed in the floor of the track 45. This projection 50 can engage in respective detents 51 and 52 in the upper edge of end wall 16 of base 10. The projection 50 engages in detent 51 when the lever cover 12 is in the open or unlatched position and in detent 52 when the lever cover 12 is in the closed or latched position.

In use of the latch device the keeper 14 is mounted by a single mechanical fastener such as a self-tapping screw engaged through bore 38 to the moving rail or fixed rail of one window sash or to a mullion or other fixture such as a portion of a fixed window frame or surround. Similarly by using suitable mechanical fasteners engaged through openings 53 in the floor 15 of base 10 the base is fitted to a rail of the movable window sash.

When the moving window sash is in the "closed" position the components of the latch device will have the relationship shown in FIGS. 2, 3, 7 and 8. To latch the window in the closed position the lever cover 12 is pushed, via pressure applied to upstand 24, toward the keeper 14. The resultant relative movement of lever cover to base causes the pins 21 of cam arms 11 to track along respective of the slots 28 which cause a counter-rotation of the two cam arms 11 about spigot 17. As a result the leading edges 54 of the cam arms 11 enter into openings 41 and moves behind the cam engagement surfaces 42. The clearances 43 adjacent curved cam receiving surfaces 42 provide a clearance for the arm 20 during such movement.

The cam portions 22 are thus moved so that the cam portions 22 fully engage behind the respective engagement surfaces 42 when the lever cover 12 has been moved to its fully closed position i.e. projections 50 engage in respective of detents 52. This engagement can be seen in FIGS. 2, 3 and 7.

Toward the end of the movement of lever cover 12 there is a degree of free motion which results in the pins 21 moving into portions 28*a* of slots 28. Consequently, a deadlocking action occurs in respect of the cam arms 11. This occurs because if someone wishes to gain unauthorised access through the window engages a thin object between the base 10 and keeper 14 to engage cam arm 11 a force cannot be applied to the cam arm 11 to cause it to rotate because of the location of pin 21 in portion 28*a*. The only way that the cam arm can rotate is by firstly moving the lever cover 24 so that the pins 21 become aligned with the main slotted portion 28. At this point rotation of the cam arms 11 can commence to release the cam arms from the keeper 14.

Because of the counter rotating cam arms 11 the action of the cam arms 11 engaging with the keeper 14 actually produces a centralising action on the window sash. Also the latch device exhibits good pull-in characteristics so that the window sash can pull onto seals at the final closed position.

Because the latch device relies on a push-pull type action applied to the lever cover 12 it is consequently easy to operate. The large gripping area formed by wall 24 allows for easy gripping in the fingers of the user so as to provide the necessary pulling action to release the latch device. Furthermore, it enables the user to pull the window to an open position. Similarly the combination of walls 24 and 25 provide a good contact area for a user to apply a pushing action to the lever cover 24 when closing and latching the window.

Because of the lost motion at the final closing of the latching device which moves the pins 21 into end portions 28*a* of slots 28 a deadlocking action on the cam arms 11 is achieved. This ensures that the latching device is secure when in the latched position and thereby resists any attempt by someone wishing to gain unauthorised access to manipulate the cam arms 11 from outside the window. The fact that the latch device employs two counter rotating latch arms 11 further ensures that unauthorised access is prevented because someone gaining access would need to simultaneously manipulate both cam arms.

What is claimed is:

1. A lock device for sliding and hung window systems, the latch device including a mounting base, a pair of counter-rotatable cam elements coupled to the base, a lever cover slidingly engaged with the mounting base, a coupling mechanism which couples the lever cover to the cam elements whereupon in use a sliding movement of the lever cover is translated into pivotal movement of the cam elements, a keeper having a pair of cam engagement surfaces with which the cam elements are engageable to latch the mounting base to the keeper and a deadlocking means whereby in use the cam elements can be deadlocked when in the latching position.

2. A latch device as claimed in claim 1 wherein said keeper includes a body with a pair of openings within each of which is located a said cam engagement surface.

3. A latch device as claimed in claim 1 wherein each cam element includes a follower which engages with a guide associated with the lever cover.

4. A latch device as claimed in claim 2 wherein the guide is a groove of substantially L-shape configured to permit the pin to slidingly move therealong.

5. A latch device as claimed in claim 4 wherein the cam element includes a bore which is mounted on a spigot of the mounting base.

6. A latch device as claimed in claim 5 wherein the lever cover includes a pair of tracks which are slidingly engaged with projecting walls of the mounting base.

7. A latch device as claimed in claim 6 wherein the lever cover includes an upstand which forms a finger engaging portion.

8. A latch device as claimed in claim 1 wherein the keeper includes a wall in which said pair of openings are formed, each opening having a first open portion which is of greater width than a second open portion, said first open portion and second open portion being connected.

9. A latch device as claimed in claim 8 wherein each cam element includes an arm portion which in the latching position is at least in part engaged through the second open portion and a curved wall at a distal end of the arm portion which passes at least in part through the first open portion as the cam element moves to and from the latching position.

10. A latch device as claimed in claim 9 wherein the cam engagement surface is a curved surface which curves away from an edge of the first open position adjacent the connection between the first open portion and second open portion.

11. A latch device as claimed in claim 1 wherein the lever cover includes a finger which is slidingly engaged in a recess in an underside of the mounting base.

12. A latch device as claimed in claim 11 wherein each cam element has a follower slidingly engaged with a guide associated with the lever cover, said guide includes a first part which extends substantially transverse to the direction of movement of the lever cover, and a second part which extends substantially in the direction of movement and into which the follower can move during a degree of free motion of the lever cover relative to the cam element when the cam element has reached the latching position.

13. A latch device as claimed in claim 12 wherein the guide is a substantially L-shaped groove.

14. A latch device as claimed in claim 12 wherein the keeper includes a pair of apertures through each of which at least part of a curved wall of a respective cam element can pass to engage with said cam engagement surface.

15. A latch device as claimed in claim 14 wherein the aperture includes a clearance to receive at least a part of an arm portion of the cam element.

16. A latch device as claimed in claim 15 wherein the arm of the cam element is pivotally mounted to the mounting base and the curved wall is located at a distance from the axis of the pivotal mounting of the arm.

17. A latch device as claimed in claim 15 further including deadlocking means whereby in use the cam elements can be deadlocked when in the latching position.

18. A lock device for sliding and hung window systems, the latch device including a mounting base, a pair of counter-rotatable cam elements coupled to the base, a lever cover slidingly engaged with the mounting base, a coupling mechanism which couples the lever cover to the cam elements, the coupling mechanism including a follower which engages with a guide associated with the lever cover, the follower being in the form of a pin which is spaced from a pivot axis about which the cam element is pivotally moveable whereupon in use a sliding movement of the lever cover is translated into pivotal movement of the cam elements, and a keeper having a pair of cam engagement surfaces with which the cam elements are engageable to latch the mounting base to the keeper.

* * * * *

UNITED STATES PATENT AND TRADEMARK OFFICE

CERTIFICATE OF CORRECTION

PATENT NO. : 6,669,242 B2
DATED : December 30, 2003
INVENTOR(S) : Fountaine et al.

It is certified that error appears in the above-identified patent and that said Letters Patent is hereby corrected as shown below:

Column 5,
Line 19, please delete "claim 11" and insert -- 1 --.

Signed and Sealed this

Thirty-first Day of May, 2005

JON W. DUDAS
*Director of the United States Patent and Trademark Office*